US007435173B2

(12) United States Patent
Rothkranz et al.

(10) Patent No.: US 7,435,173 B2
(45) Date of Patent: Oct. 14, 2008

(54) GAMING DEVICE HAVING SLIDABLE INDICATOR DISKS

(75) Inventors: Markus Rothkranz, Las Vegas, NV (US); Gene E. Powell, Reno, NV (US); Brian K. Baker, Reno, NV (US)

(73) Assignee: IGT, Reno, NV (US)

( * ) Notice: Subject to any disclaimer, the term of this patent is extended or adjusted under 35 U.S.C. 154(b) by 835 days.

(21) Appl. No.: 10/243,344

(22) Filed: Sep. 12, 2002

(65) Prior Publication Data

US 2004/0053659 A1 Mar. 18, 2004

(51) Int. Cl.
*A63F 9/24* (2006.01)

(52) U.S. Cl. ..... 463/16; 463/20

(58) Field of Classification Search ..... 463/16, 463/20–24; 273/143 R, 142; 116/222–226
See application file for complete search history.

(56) References Cited

U.S. PATENT DOCUMENTS

| | | | | |
|---|---|---|---|---|
| 2,545,644 | A | | 3/1951 | Benton et al. |
| 3,975,022 | A | | 8/1976 | Figueroa |
| 4,410,178 | A | | 10/1983 | Partridge |
| 4,676,506 | A | * | 6/1987 | Crouch ..... 273/143 R |
| 4,695,053 | A | | 9/1987 | Vazquez, Jr. et al. |
| 4,732,386 | A | | 3/1988 | Rayfiel |
| 5,152,529 | A | | 10/1992 | Okada |
| 5,364,100 | A | | 11/1994 | Ludlow et al. |
| 5,395,111 | A | | 3/1995 | Inoue |
| 5,449,173 | A | | 9/1995 | Thomas et al. |
| 5,560,603 | A | | 10/1996 | Seelig et al. |
| 5,584,763 | A | | 12/1996 | Kelly et al. |
| 5,664,998 | A | | 9/1997 | Seelig et al. |
| 5,823,872 | A | | 10/1998 | Prather et al. |
| 5,823,874 | A | | 10/1998 | Adams et al. |
| D400,597 | S | | 11/1998 | Hedrick et al. |
| D402,702 | S | | 12/1998 | Seelig et al. |
| 5,848,932 | A | | 12/1998 | Adams |
| D406,865 | S | | 3/1999 | Heidel |

(Continued)

FOREIGN PATENT DOCUMENTS

| | | |
|---|---|---|
| GB | 912 685 | 12/1962 |

(Continued)

OTHER PUBLICATIONS

Marshall Fey, Slot Machines, First Printing 1983, Liberty Belle Books, p. 168.*

(Continued)

*Primary Examiner*—Corbett Coburn
*Assistant Examiner*—O. Deodhar
(74) *Attorney, Agent, or Firm*—Bell, Boyd & Lloyd LLP

(57) ABSTRACT

A gaming device including an apparatus and method for indicating awards in a game, and specifically to an apparatus and method employing an award indicator disk display. In one embodiment, the apparatus includes a housing mounted on a cabinet of a gaming device, a support mounted in the housing and at least one award disk adapted to slideably engage the support. The disks include one or more symbols. The disks move or slide relative to the support to indicate one or more symbols to a player based on a triggering event in the game.

83 Claims, 10 Drawing Sheets

U.S. PATENT DOCUMENTS

| | | | | |
|---|---|---|---|---|
| 5,882,261 | A | 3/1999 | Adams | |
| 5,911,418 | A | 6/1999 | Adams et al. | |
| 5,927,714 | A | 7/1999 | Kaplan | |
| 5,976,015 | A | 11/1999 | Seelig et al. | |
| 6,004,207 | A | 12/1999 | Wilson, Jr. et al. | |
| 6,059,658 | A | 5/2000 | Mangano et al. | |
| 6,086,066 | A | 7/2000 | Takeuchi et al. | |
| 6,089,977 | A | 7/2000 | Bennett | |
| 6,089,978 | A | 7/2000 | Adams et al. | |
| 6,105,962 | A | 8/2000 | Malavazos et al. | |
| 6,113,098 | A | 9/2000 | Adams | |
| 6,142,873 | A | 11/2000 | Weiss et al. | |
| 6,142,874 | A | 11/2000 | Kodachi et al. | |
| 6,159,098 | A | 12/2000 | Slomiany et al. | |
| 6,162,121 | A | 12/2000 | Morro et al. | |
| 6,173,955 | B1 | 1/2001 | Perrie et al. | |
| 6,203,429 | B1 | 3/2001 | Demar et al. | |
| D441,031 | S | 4/2001 | Seelig et al. | |
| 6,213,876 | B1 | 4/2001 | Moore, Jr. | |
| 6,220,593 | B1 | 4/2001 | Pierce et al. | |
| 6,224,483 | B1 | 5/2001 | Mayeroff | |
| 6,227,970 | B1 | 5/2001 | Shimizu et al. | |
| D443,313 | S | 6/2001 | Brettschneider | |
| 6,251,013 | B1 | 6/2001 | Bennett | |
| 6,254,481 | B1 | 7/2001 | Jaffe | |
| 6,267,669 | B1 | 7/2001 | Luciano, Jr. et al. | |
| 6,270,411 | B1 | 8/2001 | Gura et al. | |
| 6,302,790 | B1 | 10/2001 | Brossard | |
| 6,305,686 | B1 | 10/2001 | Perrie et al. | |
| 6,315,663 | B1 | 11/2001 | Sakamoto | |
| 6,336,863 | B1 | 1/2002 | Baerlocher et al. | |
| 6,340,158 | B2 | 1/2002 | Pierce et al. | |
| 6,368,216 | B1 | 4/2002 | Hedrick et al. | |
| 6,386,974 | B1 | 5/2002 | Adams | |
| 6,419,579 | B1 | 7/2002 | Bennett et al. | |
| 6,461,241 | B1 | 10/2002 | Webb et al. | |
| D465,531 | S | 11/2002 | Luciano, Jr. et al. | |
| 6,481,713 | B2 | 11/2002 | Perrie et al. | |
| 6,533,660 | B2 | 3/2003 | Seelig et al. | |
| 6,537,152 | B2 | 3/2003 | Seelig et al. | |
| 6,582,307 | B2 | 6/2003 | Webb | |
| 6,609,972 | B2 * | 8/2003 | Seelig et al. | 463/16 |
| 6,712,694 | B1 | 3/2004 | Nordman | |
| 6,800,030 | B2 * | 10/2004 | Acres | 463/25 |

FOREIGN PATENT DOCUMENTS

| | | | |
|---|---|---|---|
| GB | 2 204 436 | A | 11/1988 |
| GB | 2 341 262 | A | 6/1998 |
| GB | 2 338 578 | A | 12/1999 |

OTHER PUBLICATIONS

4DU Dice Unit Advertisement written by starpoint.uk.com, printed on Sep. 3, 2002.
American Bandstand Brochure written by Anchor Games, published in 2001.
Big Shot!™ Advertisement published by Aristocrat Technologies, Inc., published in 2002.
Big Top Keno Advertisement published by Aristocrat Technologies, Inc., published in 2000.
Bonus Roulette Brochure written by F. Franco, not dated.
Buck's Roulette Brochure written by R. Franco, not dated.
Chariot's of Fortune Brochure written by R. Franco, not dated.
Classic Pot of Gold Brochure written by Ace Coin Equipment Ltd., not dated.
Cyberdyne Gaming Brochure written by Cyberdyne Gaming, not dated.
Elvira® Mistress of the Dark™ Advertisement written by IGT, published in 2002.
Elvis Hits Advertisement written by IGT, published in 1999.
Holy Smoke Brochure written by Impulse Gaming Ltd., not dated.
Jack and the Beanstalk™ Brochure written by AC Coin & Slot, not dated.
King of the Grill™ Brochure written by AC Coin & Slot, not dated.
Line-Up Brochure written by AC Coin & Slot, not dated.
Little Green Men Jr.™ Advertisement written by AC Coin & Slot, not dated.
Little Green Men Jr.™ Article written by Strictly Slots, published in Feb. 2003.
Miss America Brochure written by AC Coin & Slot, not dated.
Mix and Match Article written by Strictly Slots, published in Apr. 2002.
Mix and Match Advertisement published by AC Coin & Slot, not dated.
Money Grab Article written by Strictly Slots, published in Apr. 2001.
Monster Match Article written by Strictly Slots, published in Jan. 2002.
On The Money! Article written by Strictly Slots, published in Dec. 2000.
Payout!™ Advertisement written by www.csds.com/Gaming/Products/g_Payout.htm, printed on Jan. 15, 2001.
Payout!™ Article written by Casino Data Systems, not dated.
Pick a Prize Brochure written by Acres Gaming Incorporated, published prior 2001.
Power Slotto Brochure published by AC Coin & Slot prior to 2002.
Press Your Luck Brochure published by AC Coin & Slot prior to 2002.
Quick Pick Paytime Brochure written by Acres Gaming Incorporated, published prior to 2001.
R&B™ Brochure published by AC Coin & Slot, not dated.
Reel Dice Advertisement written by Gerber & Glass, published in 1936.
Royal Roulette Brochure written by Impulse Gaming Ltd., not dated.
Slot Machine Buyer's Handbook, A Consumer's Guide to Slot Machines written by David L. Saul and Daniel R. Mead, published in 1998.
Silver City Roundup Brochure published by AC Coin & Slot, not dated.
Slot Machines A Pictorial History of the First 100 Years, 5th edition written by Marshall Fey, published in 1983-1997.
Slot Machines on Parade, 1st edition written by Robert N. Geddes and illustrated by Daniel R. Mead, published in 1980.
Spin-A-Lot Brochure written by Acres Gaming Incorporated, published prior to 2001.
Take Your Pick Article written by Strictly Slots, published in Mar. 2001.
Yahtzee Bonus Advertisement written by Mikohn, published in 1999.

* cited by examiner

GAMING DEVICE HAVING SLIDABLE INDICATOR DISKS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device, and more particularly to a gaming device including slidable award indicator disks.

Gaming device manufacturers strive to make gaming devices that provide as much enjoyment, entertainment and excitement as possible to players. Providing interesting and exciting primary games and secondary games in which a player has an opportunity to win potentially large awards or credits is one way to enhance player enjoyment and excitement. Another way to enhance a player's enjoyment, entertainment and excitement with a gaming device is by including lights, sounds and other visual or audio or audio-visual effects in the gaming machines.

Some known gaming devices use mechanical devices such as reels or wheels to enhance the attraction of the machines to players and also to enhance the player's game playing experience. These mechanical devices enable a player to see a physical representations of a game or a portion of a game, which increases the player's enjoyment of the game.

Therefore, to increase player enjoyment and excitement, it is desirable to provide new and different mechanical devices in conjunction with gaming devices.

SUMMARY OF THE INVENTION

The present invention is directed to a gaming device including a plurality of slidable indicator disks. More specifically, the gaming device includes a disk display which is part of or attached to the cabinet of the gaming device. The disk display includes slidable indicator disks which each display a symbol to a player based upon a triggering event in a game. The disk display may be employed in any type of game such as a primary or base game, secondary or bonus game, sub-game or in another mode of the gaming device.

In one embodiment, the disk display includes a housing mounted on top of a cabinet of the gaming device, a support mounted in the housing and at least one indicator disk that moves relative to the support. In one presently preferred embodiment, the indicator disks slideably engage the support. A suitable actuator moves the disks relative to or causes the disks to move relative to the support to indicate awards to a player. In the presently preferred embodiment, the disks are cylindrical. However, the disks may be any suitable shape. The disks may include award symbols to indicate one or more awards in a game. The awards may be any type of awards such as credits, values, multipliers, free games or free spins. Alternatively, the disks may include symbols which are each employed as a game element or function in a primary game, secondary game or sub-game.

In one embodiment, a disk storage enclosure is mounted on the top of the cabinet of the housing to store and initially hide the disks from the player. The disks are then released from the disk storage enclosure and move or slide relative to the support in the housing. In one embodiment, the housing preferably includes a transparent portion that enables a player to view the disks through the housing. In another embodiment, the housing defines an opening that enables the player to view the disks.

In one embodiment, the disk display includes a single disk having one or more symbols. The symbol indicated to the player is based on a triggering event in the game. In one embodiment, the symbols are award symbols and represent a single award or several different types of awards such as credits, multipliers and free games as desired by the game implementor. The symbols may also represent game elements or functions in a game.

In another embodiment, the disk display includes a plurality of slidable disks which indicate different awards or game elements in a game. The disks each include a symbol which indicates an award or game element to the player.

In a further embodiment, the disk display includes a plurality of disks wherein each disk includes a plurality of symbols. In one embodiment, the symbols on each disk represent different awards. In one aspect of this embodiment, the indicated symbol is the symbol that is facing the player when the disk is displayed to the player. In another aspect of this embodiment, a suitable actuator such as a motor rotates the support to indicate one or more of the symbols on the disk. The support rotates incrementally to indicate the different symbols on the disk.

It should be appreciated that the disk display of the present invention may be employed as part of a primary game, secondary or bonus game, sub-game, or any suitable type of wagering game. Additionally, it should also be appreciated that a single disk display or a plurality of disk displays may be employed in a gaming device. In one embodiment including multiple disk displays, a single disk is included in each of the disk displays. The disks in the displays include different symbols. In another embodiment, a plurality of disks are included in each of the disk displays. In this embodiment, the disk displays may include disks having the same symbols or different symbols. Furthermore, the disks may include symbols associated with relatively small awards, relatively large awards or any combination therein.

In a further embodiment, the gaming device includes a plurality of disk displays and an input such as a select button associated with each of the disk displays. The player presses or activates the input, such as the button to select and activate one of the disk displays in a game. The player then obtains the symbols indicated by the disks in the disk display picked by the player. It should be appreciated that the player may select one or more disk displays in a game.

It is therefore an advantage of the present invention to provide a gaming device including an award indicator display that provides new visual stimuli to a player.

Another advantage of the present invention is to provide a physical award indicator which increases a player's excitement and enjoyment of a game.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
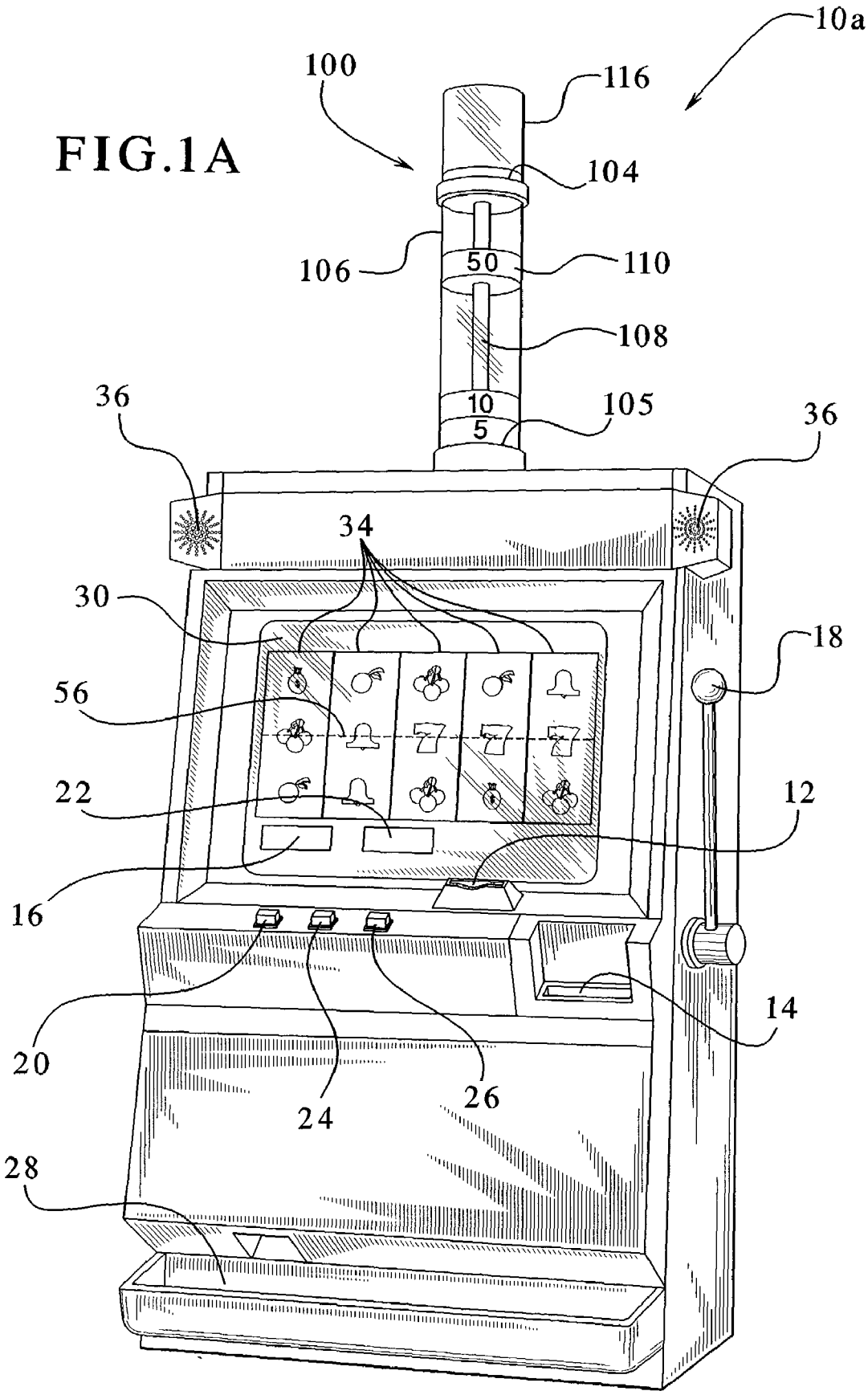
FIG. 1A is a front perspective view of one embodiment of the gaming device in the present invention.
Figure 1B:
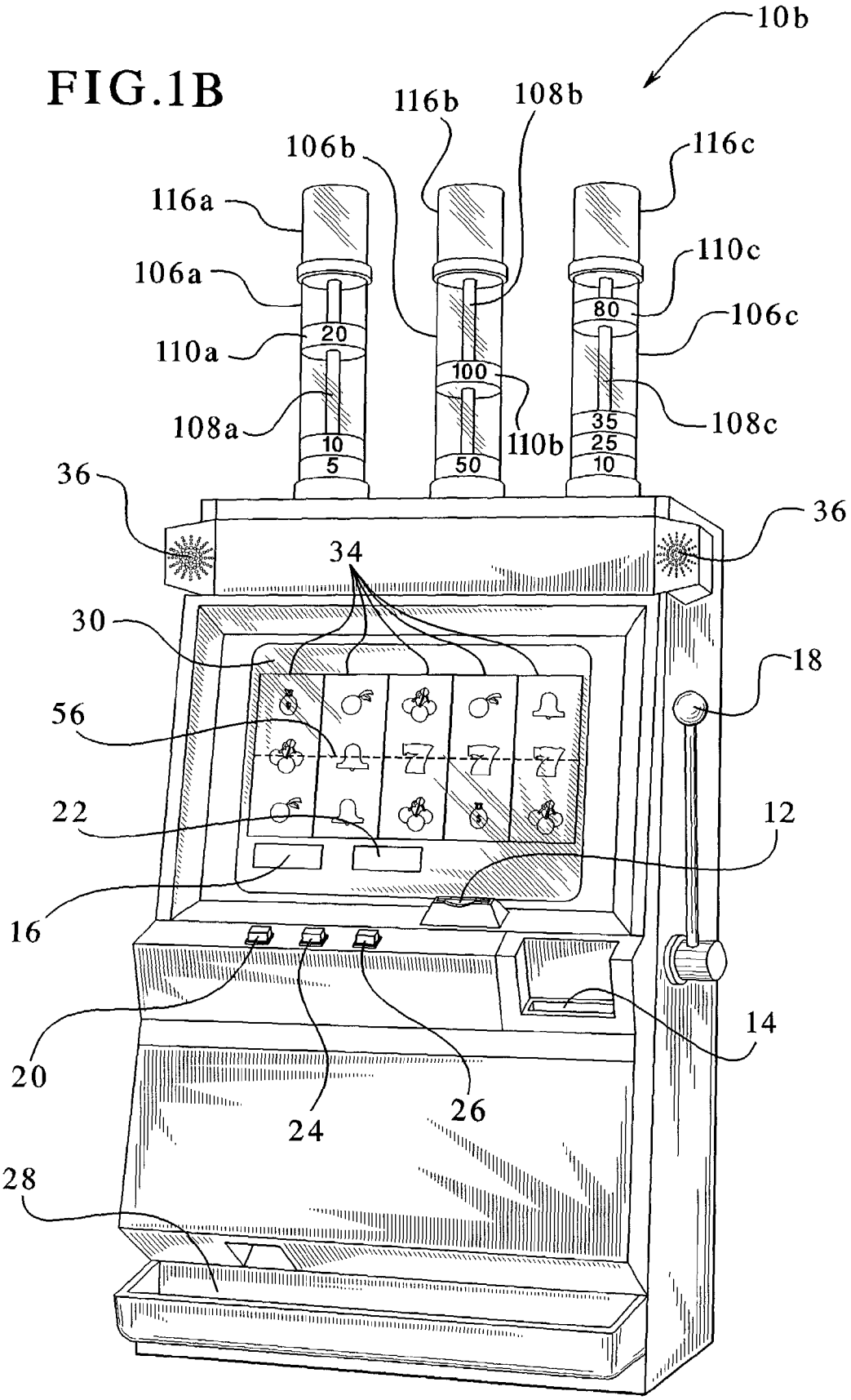
FIG. 1B is a front perspective view of another embodiment of the gaming device in the present invention.
Figure 1C:
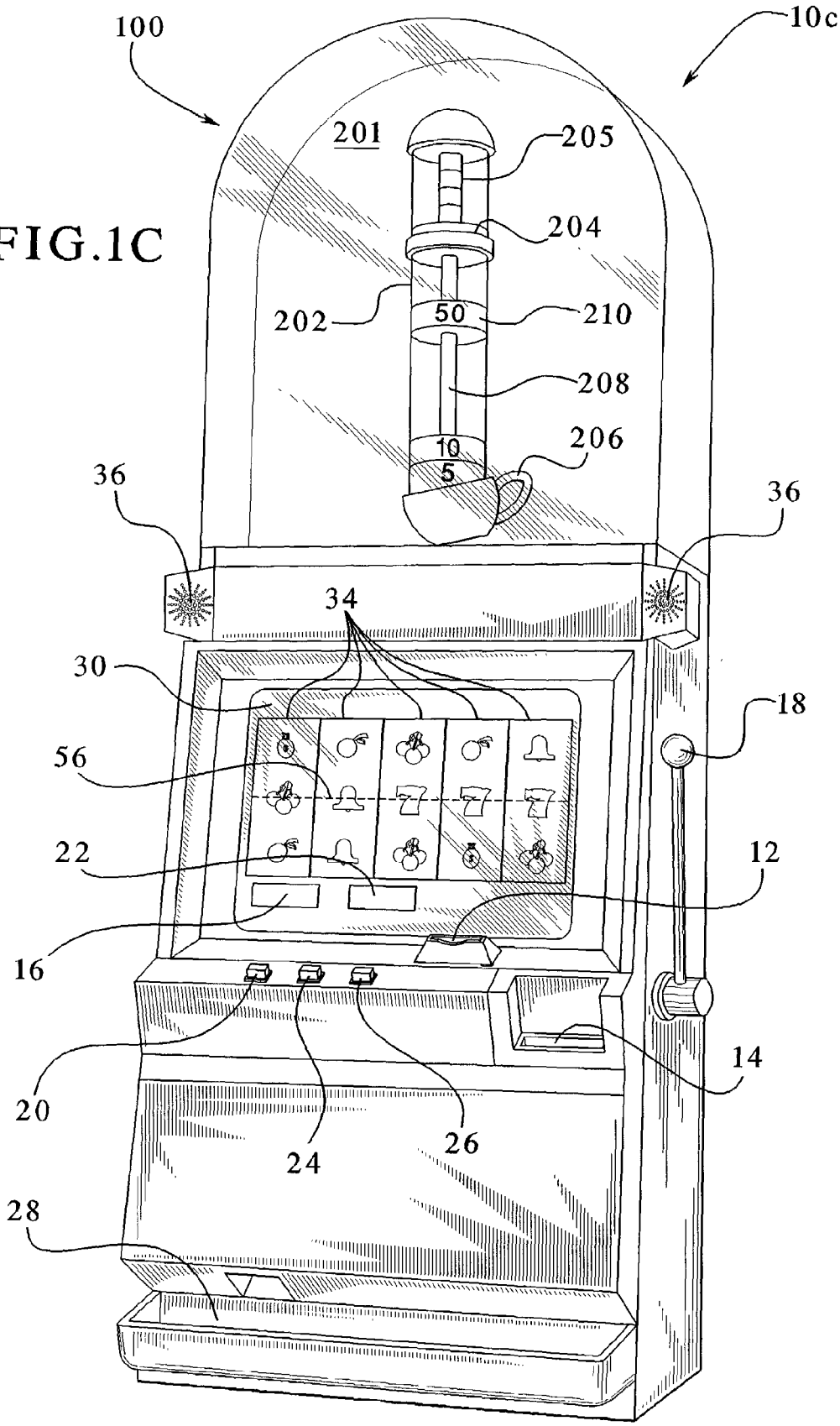
FIG. 1C is a front perspective view of a further embodiment of the gaming device in the present invention.

Referring now to the drawings, three embodiments of the gaming device of the present invention are illustrated in FIGS. 1A, 1B and 1C as gaming device 10*a*, 10*b* and 10*c* respectively. Gaming device 10*a* device 10*b* and/or 10*c* are generally referred to herein as gaming device 10. Gaming device 10 is in one embodiment, a slot machine having the controls, displays and features of a conventional slot machine. It is constructed so that a player can operate it while standing or sifting, and gaming device 10 is preferably mounted on a console in a cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A, 1B and 1C.

Gaming device 10 can incorporate any suitable primary game such as slot, poker, blackjack or keno, any of the bonus triggering events and any of the bonus round games associated with these primary games. The symbols and indicia used on and in gaming device 10 may be in mechanical, electrical, electronic or video form.

As illustrated in FIGS. 1A, 1B and 1C gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player who starts any game or sequence of events in the gaming device.

As shown in FIGS. 1A, 1B and 1C, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming device may also include conventional "bet max" and "repeat the bet" buttons.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30 and a disk display 100. Another embodiment shown in FIG. 1B includes the central display device 30 and a plurality of disk displays. In a further embodiment shown in FIG. 1C, the gaming device includes the central display device 30 and a disk display 200. Gaming device 10 may display a plurality of reels 34, such as three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
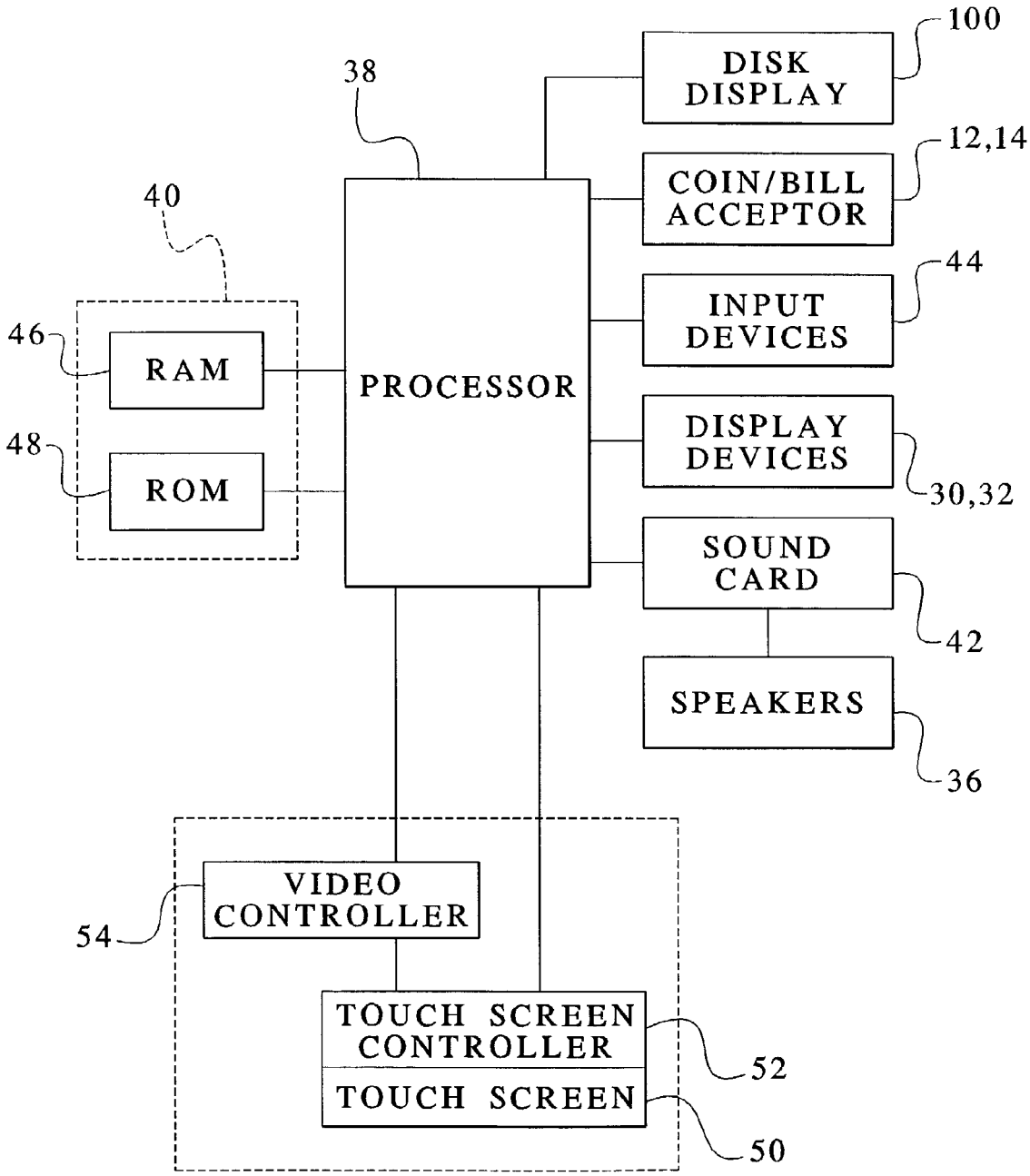
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a disk display 100 or 200; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hardwired devices, or using mechanical devices (collectively or alternatively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round or bonus game. This type of gaming device 10 will include a program which will automatically begin a bonus round when the player has achieved a qualifying condition in the game. This qualifying condition can be a particular arrangement of indicia on a display device. The gaming device 10 may use a video-based central display device 30 to enable the player to play the bonus round. The qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Indicator Disks

Figure 3:
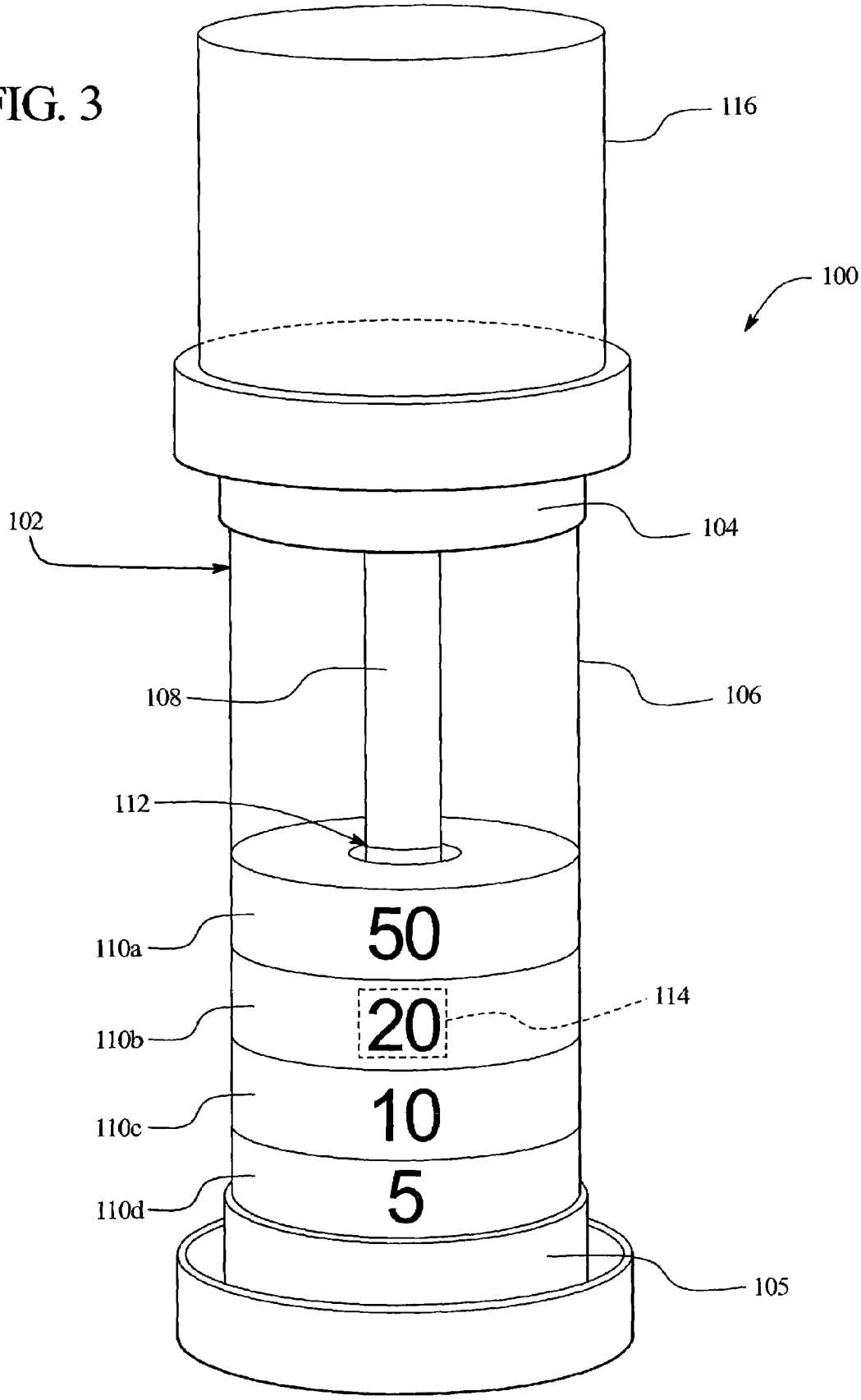
FIG. 3 is an enlarged perspective view of one embodiment of the disk display of the present invention.
Figure 4:
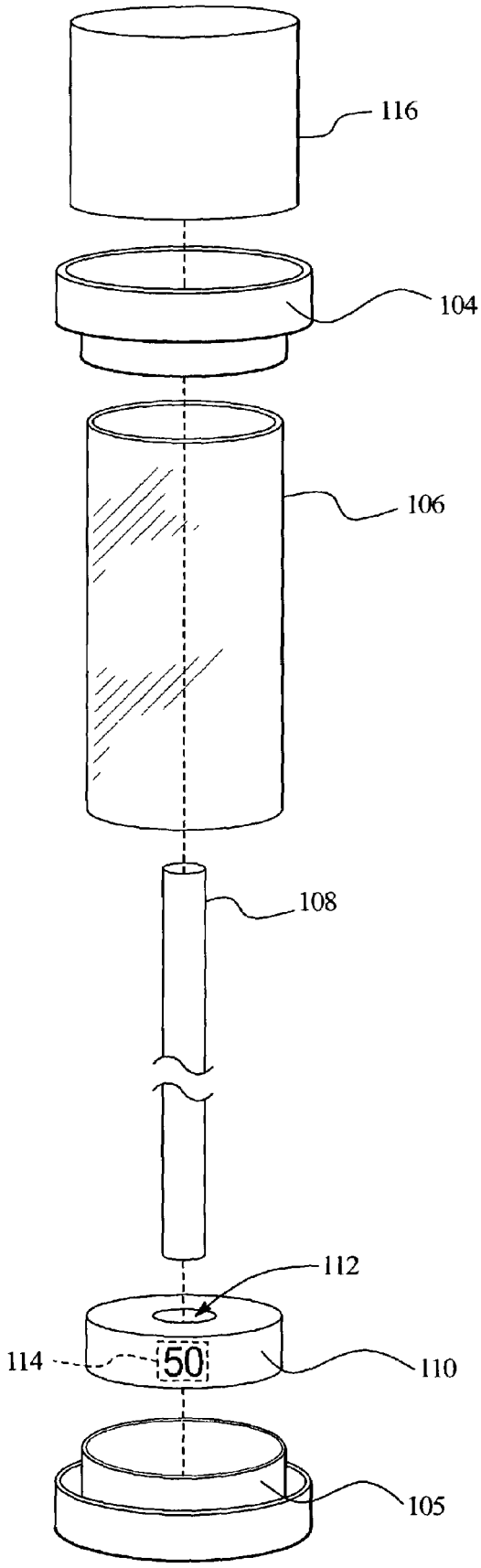
FIG. 4 is an exploded perspective view of one embodiment of the disk display of the present invention.

Referring now to FIG. 3, one embodiment of the disk display 100 of the present invention includes a housing 102 mounted to the cabinet of the gaming device, a support 108 mounted in the housing and one or more slidable indicator disks 110 which are positioned in the housing and move relative to the support 108. The housing 102 includes opposing end caps 104 and 105, which are positioned at each end of a transparent member or tube 106. It should be appreciated that the bottom end cap 105 may be suitably mounted to the cabinet of the gaming device. The top end cap 104 and the bottom end cap 105 are adapted to fit on or around the ends of the transparent tube 106. The bottom end cap 105 is mounted on or secured to the gaming device using suitable fasteners. The top end cap 104 is open-ended and adapted to receive a disk storage enclosure 116. The top end cap 104 is manufactured to connect with the disk storage enclosure 116. In one embodiment, the transparent member 106 includes a substantially transparent material which enables a player to see through the member. In another embodiment, the transparent member of the housing defines at least one opening to enable a player to view the disks in the housing.

In one embodiment, a support such as a cylindrical support 108 is mounted in the housing 102. The support 108 is manufactured from a suitable material and is substantially vertically positioned inside the housing 102 and substantially in the center of the housing 102. It should be appreciated that the support 108 may be any suitable shape or configuration.

In one embodiment, a disk 110 is adapted to slidable move relative to the support 108. The disk 110 is preferably cylindrical. However, it should be appreciated that the disk may be any suitable shape or configuration. Each disk 110 defines an aperture or opening 112 which extends through the disk. The opening 112 is sized to correspond to the size of the support 108. In one embodiment, the opening 112 in the disk 110 includes a diameter that generally corresponds to the diameter of the cylindrical support 108. The diameter of the disk 110 is sized such that the opening 112 on the disk 110 is received by the support so that the disk is able to move relative to the support. Accordingly, one or more disks 110 may slideably engage the support 108. It should be appreciated that the disks do not have to directly engage the support. The disks may be attached to a suitable actuator which is separate from the support 108 and moves the disks relative to the support. The disks and actuator may also be attached to the housing so that the disks may be positioned in and move relative to the housing.

Each disk 110 includes at least one symbol such as an award symbol 114. The award symbols 114 represent any type of an award such as values, credits, multipliers, free spins or free games. The award symbols 114 may be included on one surface of the disk 110 or on multiple surfaces of the disk 110. Furthermore, the awards associated with the award symbols may vary in value as desired by the game implementor. For example, the awards in FIG. 3 include the awards of fifty, twenty, ten and five. In one embodiment, the player receives the awards associated with the award symbols indicated by the disks. In another embodiment, the awards associated with the indicated award symbols are summed or added together to provide the total award to the player. It should be appreciated that the indicated awards on the disks may be added, multiplied or modified in any suitable manner.

Alternatively, the disks 110 may include one or more symbols which represent game elements or functions in a game. The symbols on the disk are employed as part of a function of the game such as providing an additional symbol to a combination of symbols on a set of reels. It should be appreciated that the disks include one or more symbols and provide one or more functions in a game. It should also be appreciated that the disks and symbols may be employed as part of a primary game, bonus game, or sub-game.

In one embodiment, the disk displays 100 include a plurality of disks 110. In this embodiment, each of the slidable disks includes a different symbol such as the award symbol 114. In another embodiment, one or more of the disks 110 in the disk display include a plurality of award symbols 114. In one aspect of this embodiment, the award symbols represent the same award. Therefore, the award symbol on the disk 110 may be viewed by the player regardless of the position of the disk inside of the housing 102. In another aspect of this embodiment, the disk 110 includes a plurality of different award symbols 114. Each award symbol 114 represents a different award. In this aspect of the embodiment, the award indicated by the disk display 100 is the award that is primarily viewable by the player or the award symbol that faces the player.

In another embodiment, the support 108 rotates within the housing 102. In this embodiment, the support 108 is attached to a suitable actuator or motor which rotates the support to indicate one or more of the award symbols 114 on the disk 110. The awards provided to the player in a game are based on the award symbols 114 indicated on the disk 110, which rotates to be viewable by the player on the support 108. It should be appreciated that the support 108 may rotate incrementally to indicate the different award symbols 114 on the disk 110.

Referring to FIGS. 5A, 5B, 5C and 5D, different embodiments of the award disk or disk of the present invention are illustrated where different symbols are displayed on the disk. In one embodiment illustrated in FIG. 5A, the disk 110 includes a body 113 that defines an opening 112 which extends through the body. The opening 112 as described above, is suitably sized to fit about the support 108. In the illustrative embodiment, an award symbol 114*a* is positioned on the disk 110. The award symbol 114*a* may be molded or integrally formed on the body 113 of the disk 110. Alternatively, the award symbol 114*a* may be a separate component and secured to the body 113 of the disk 110 using a suitable attachment method.

Figure 5A:
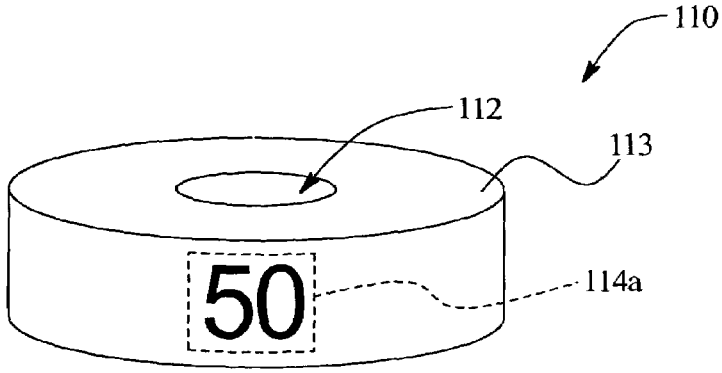
FIGS. 5A, 5B, 5C and 5D are schematics of four different embodiments of the disks of the present invention.
Figure 5B:
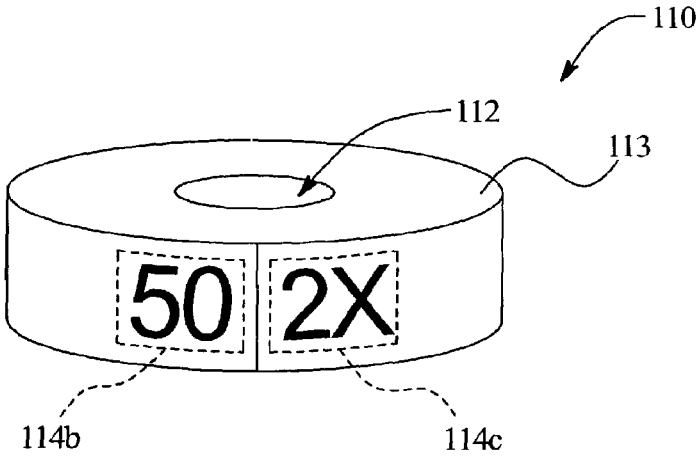

Referring to FIG. 5B, another embodiment of the award disk or disk 110 is illustrated where the slidable disk includes a plurality of different award symbols 114. In this embodiment, the disk 110 includes a body 113 which defines an opening 112 as described above. The disk 110 includes a plurality of award symbols 114 such as the award symbol of fifty (114*b*) and the award symbol including the multiplier "2×" (114*c*). This embodiment may be used in a gaming device to provide the player with multiple awards in a single triggering event. For example, the player will receive an award of fifty and a "2×" multiplier based on the award symbols indicated on the disk shown in FIG. 5B.

Figure 5C:
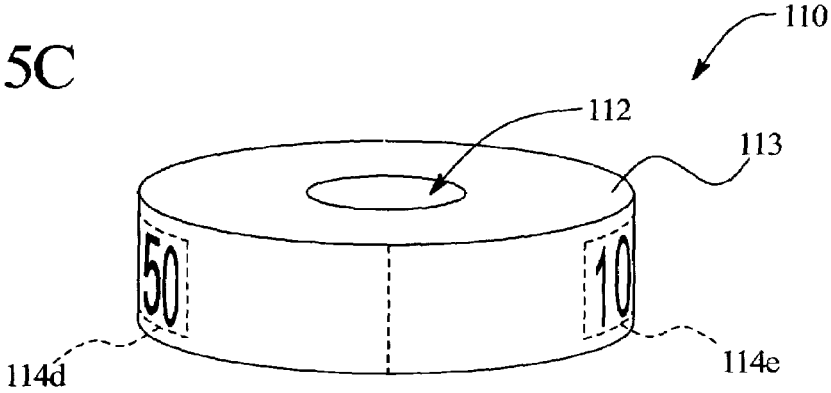

Referring now to FIG. 5C, a further embodiment of the disk 110 of the present invention is illustrated where the disk includes a plurality of different awards. In this embodiment, the disk 110 includes a body 113 which defines an opening 112 as described above. The body 113 of the disk 110 includes award symbols 114*d* and 114*e*. The award symbols include an award of fifty (114*d*) and an award of ten (114*e*). This embodiment may be used in a gaming device to indicate one or more awards to a player. The award symbols 114*d* and 114*e* may be randomly displayed to the player or rotated incrementally by the support 108 to indicate one of the award symbols on the disk 110. It should be appreciated that the number of award symbols and the type of award symbols may vary based on the desire of the game manufacturer.

Figure 5D:
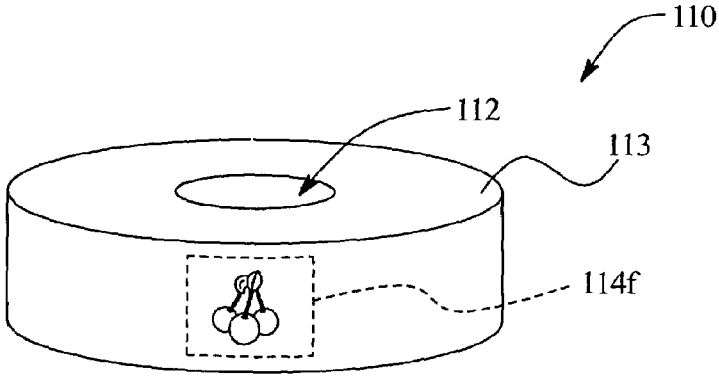

Referring now to FIG. 5D, another embodiment of the disk 110 of the present invention is illustrated where the disk includes a symbol which is a game element in a game. The symbol 114*f* represents a cherry symbol. The cherry symbol may be indicated and added to a combination of symbols on a set of reels or in some other suitable game. Thus, the cherry symbol acts as a game element and provides a function in a game. It should be appreciated that the symbol may be any symbol or game element as desired by the game manufacturer. It should also be appreciated that the disk 110 may include one or several symbols on the disk.

In another embodiment, a plurality of disk displays 100 are mounted to the top portion of the cabinet of the gaming device 110 as shown in FIG. 1B. In this embodiment, the disk displays 100 may each include a single disk 110 or a plurality of disks 110. Additionally, the disks may include one or more symbols such as award symbols 114. In the embodiment, the disk displays include disks with a single award symbol. The gaming device indicates an award symbol in one of the disk displays that corresponds to the award provided to the player by the award triggering event in the game. In the embodiment including multiple disks in the disks displays 100, the disks may be displayed one at a time or simultaneously. In one aspect of the present embodiment, one of the disks associated with the disk displays includes a plurality of relatively large awards. It should also be appreciated that the disk displays may include disks having relatively small awards, relatively large awards or any combination therein.

In a further embodiment, the gaming device includes a plurality of disk displays and at least one selector such as a select button (not shown) associated with the disk displays. The player presses or touches the selector to select and activate one of the disk displays. The player then receives the award indicated by the disks in the selected disk display. It should be appreciated that the gaming device may also include a plurality of selectors where at least one selector is associated with each of the disk displays. The player selects a disk display by pressing or touching the corresponding selector associated with the desired disk display.

Referring to FIGS. 1C, 6A, 6B, and 6C, one preferred embodiment of the gaming device of the present invention is illustrated where a disk display 200 indicates the award symbols on the disk to a player. In this embodiment, the gaming device includes a first housing 202 coupled to a second housing 212 where the second housing is mounted to one side of a mounting plate 201. A disk mover 213 is mounted on the opposing side of mounting plate 201. The disk mover 213 is coupled with and rotated by a rotation generator (not shown). In operation, the rotation generator rotates the disk mover 213, which causes the disk mover to move one or more of the disks in the second housing 212 to indicate one or more award symbols on the disks. An award or award associated with the indicated award symbols is provided to the player. The following paragraphs further describe the components of the present invention.

Figure 6A:
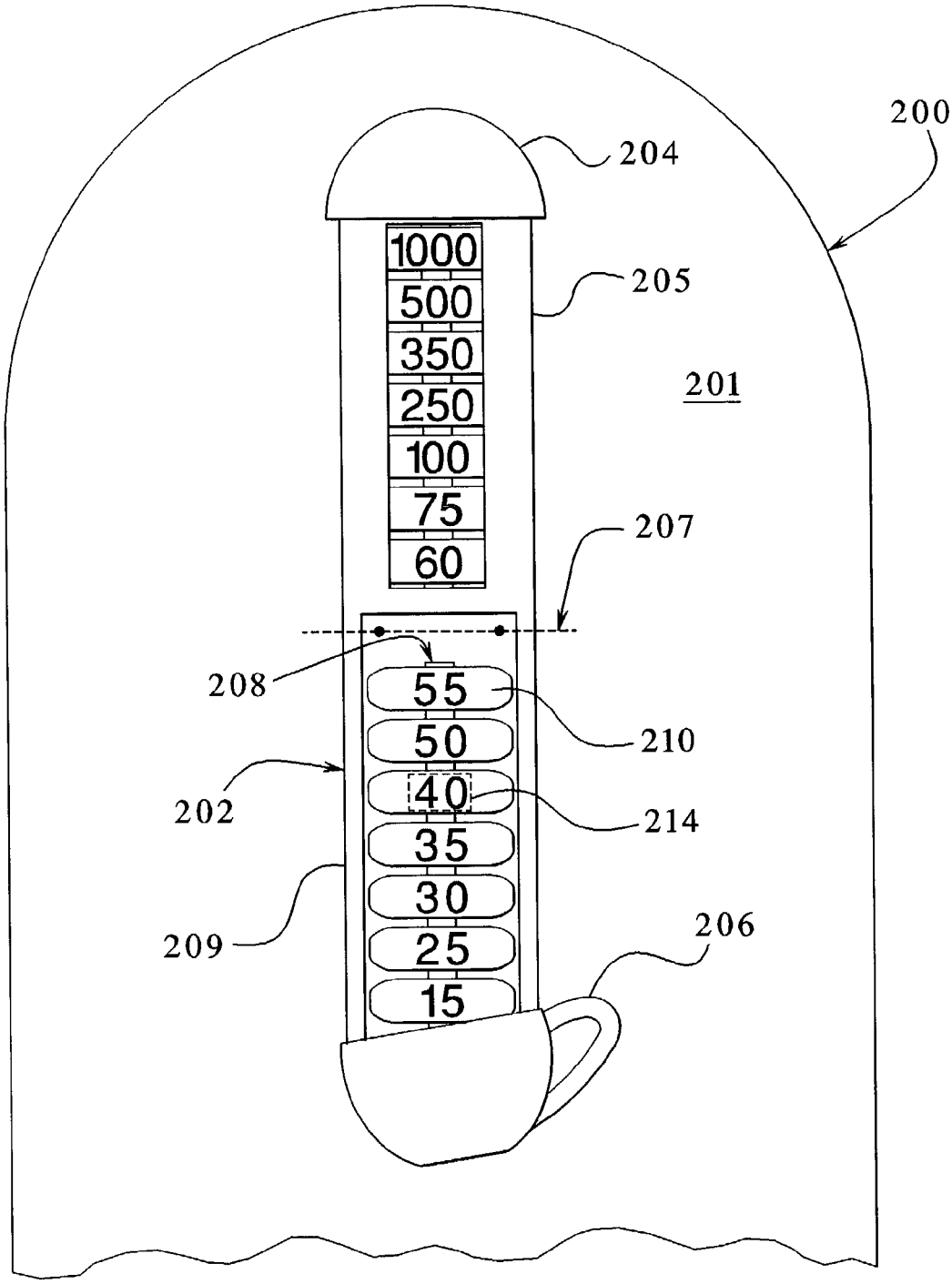
FIG. 6A is an elevation view of the disk display of the embodiment shown in FIG. 1C.
Figure 6B:
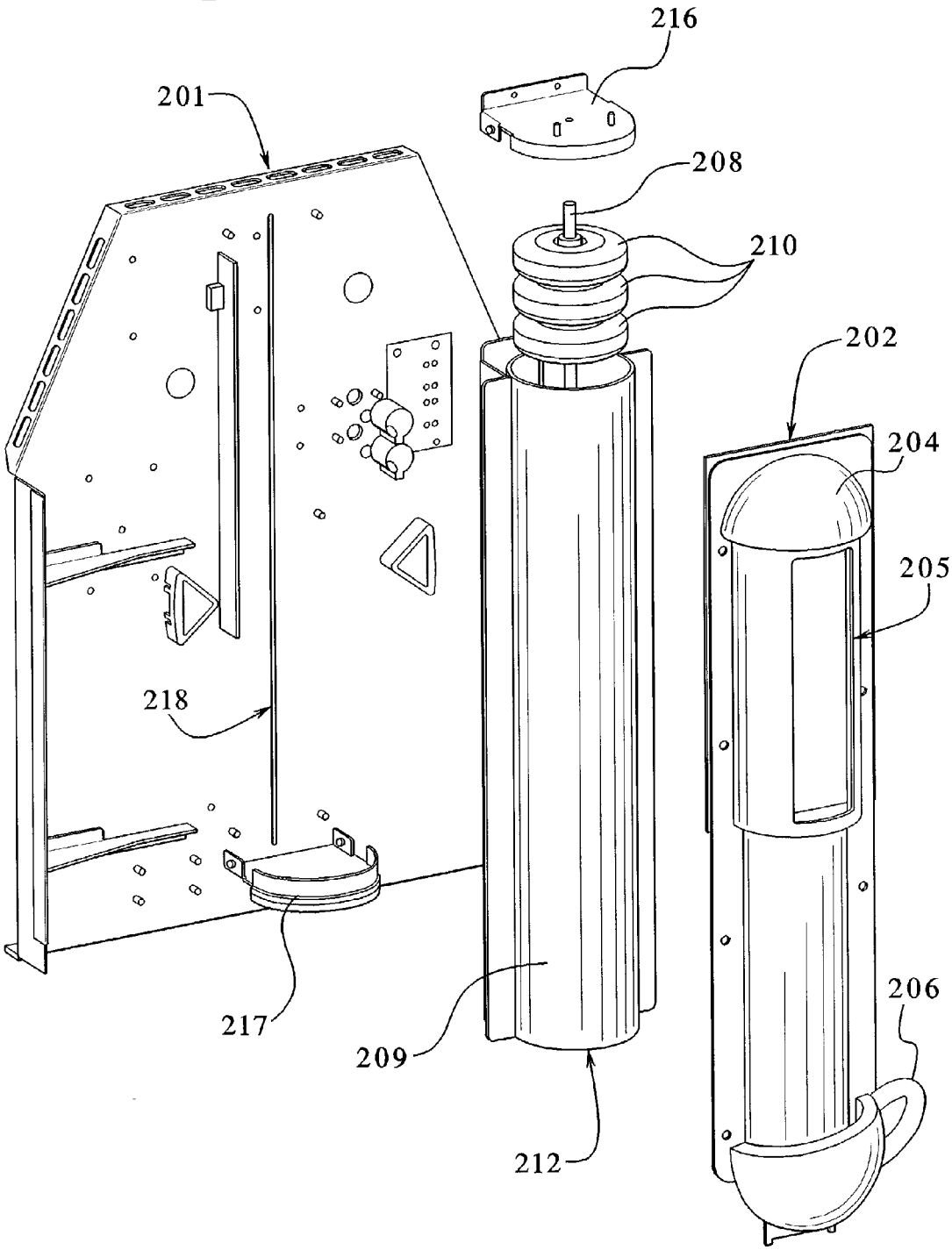
FIG. 6B is an exploded perspective view of the embodiment of FIG. 6A.

The mounting plate 201 is secured or fastened to the top of the cabinet of the gaming device using suitable fasteners. The mounting plate 201 provides support for the first housing and the moving components of the embodiment. The first housing 202 as shown in FIG. 6B, is integrally formed as a single housing. Alternatively, the first housing 202 may be manufactured as separate components and combined to form the first housing. The first housing 202 includes a top end cap 204 and a bottom end cap 206, which in this embodiment is in the form of a cup. It should be appreciated that either end cap or the first housing may be manufactured in accordance with the theme of a game or any theme desired by the gaming machine manufacturer.

In one embodiment the top end cap 204 defines an opening 205 or a see-through area, which enables a player to view the award symbols on the award disks 210. In another embodiment, the top end cap is a solid unit where the disks 210 are not viewable in the housing. A second housing 212, which is generally adjacent to the first housing 202, is integrally formed from a suitable material and includes a transparent member 209. The transparent member 209 enables a player to see through the second housing 212 to see the award symbols on the disks 210.

In one presently preferred embodiment, the second housing 212 is substantially cylindrical and is formed as a tube having a hollow interior portion. A cylindrical support 208 slideably engages the disks 210 so that the disks move relative to the support 208. The support 208 and the disks 210 are manufactured to fit within the second of the housing 212 as shown in FIG. 6B. The second housing 212 is mounted to the mounting plate 201. A top plate 216 mounted to the front surface of the mounting plate 201, fits on top of the second housing and secures the top portion of the support 208 in place. The top plate 216 is manufactured so that the support 208 rotates relative to the top plate 216. Similarly, a bottom plate 217 is secured to the mounting plate 201 and is mounted to the bottom of the second housing 212 to support the second housing 212 as well as to secure the bottom of the support 208 in place. The bottom plate 217 is manufactured so that the support 208 rotates relative to the bottom plate 217. The mounting plate 201 defines a channel or slot 218, which is used to control the movement of the disks within the back housing as described below. In one embodiment, the first housing 202 is mounted to the second housing 212 after the second housing is secured to the mounting plate 201. In another embodiment, suitable fasteners engage both the first housing and the second housing and mount the first housing and second housing to the mounting plate 201.

Figure 6C:
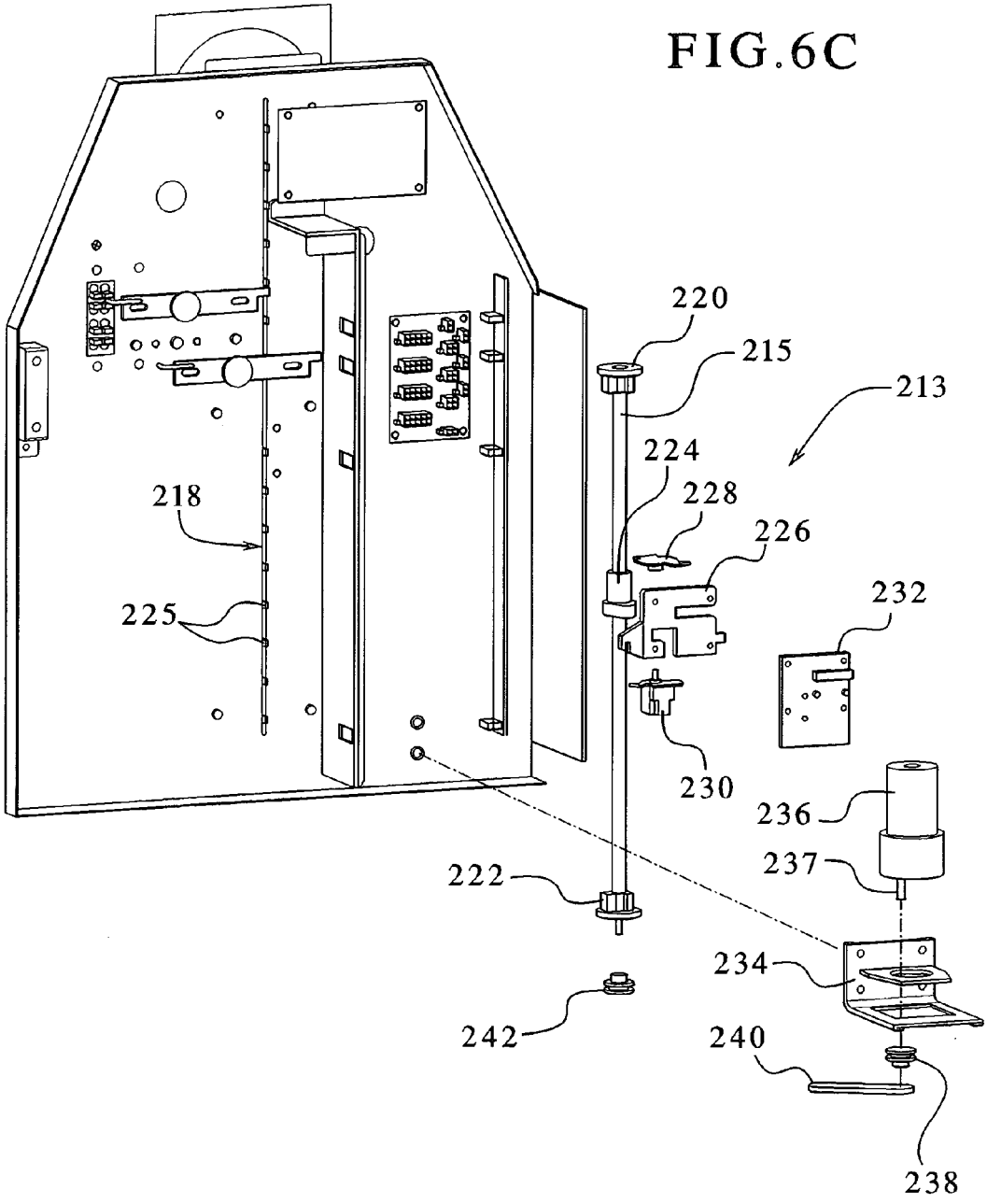
FIG. 6C is an exploded rear perspective view of the embodiment of 6A.

The disk mover 213 is mounted on the opposing side or surface of the mounting plate 201 and controls the movement of the disks within the second housing as illustrated in FIG. 6C. The disk mover 213 includes a disk transport plate 228 movably connected to a disk transport housing. The disk transport plate 228 engages one of several disk arms 225 transversely extending from each of the disks 210. The disk transport housing 226 is coupled with a disk transport shaft or transport shaft 215, which moves the disk transport housing, disk transport plate and the disk arm engaged with the disk transport plate. Accordingly, one or more disks 210 may be moved within the second housing 212 to indicate an award symbol on one or more of the disks.

Each disk 210 includes a disk arm 225 which is integrally formed with the disk and transversely extends from each of the disks 210 through a slot 218 defined by the mounting plate 201 as shown in FIG. 6C. It should be appreciated that the disk arms may alternatively be separate parts that are attached or secured to each of the disks. One of the disk arms 225 engages the disk transport plate 228. The disk transport plate 228 moves one or more of the disks relative to the second housing 212. The disk transport plate 228 is secured to a disk transport housing 226.

In addition, a rotation generator (not shown) moves or rotates the transport shaft 215 to move the disk transport housing and disk transport plate along the support. The rotation generator includes a first actuator 230 which engages the disk transport plate 228. The first actuator 230 may be any suitable actuator such as a suitable electric stepper motor, where the first actuator 230 rotates the disk transport plate 228. The first actuator 230 is also mounted to the disk transport housing using suitable fasteners.

The disk transport housing 226 is secured to a support transport member 224 on a transport shaft 215. The support transport member 224 is secured to the top surface of the disk transport housing 226. The support transport member 224 is generally cylindrically shaped and is manufactured to engage the shaft 215. The interior portion of the support transport member 224 includes threads, which engage corresponding threads integrally formed on the shaft 215. Thus, the disk transport housing 226 moves relative to the shaft 215 as the threads of the support transport member 224 engage the threads on the shaft 215.

The transport shaft or shaft 215 includes the top support member 220 and a bottom support member 222 which fit onto and engage the shaft 215. The top support member and bottom support members 220 and 222, respectively, are secured to a top support surface (not shown) and a bottom support surface (not shown). The top and bottom surfaces are suitably mounted to the mounting plate 201. Therefore, the top and bottom support surfaces support or secure the shaft 215 in place. An intermediate plate 232 is secured to the back of the disk transport housing 226. The intermediate plate 232 enables electrical connections such as electrical cables to be secured to the disk transport housing 226. In this manner, the processor 38 communicates with the first actuator 230 to rotate the disk transport plate relative to the disk transport housing 226.

A second actuator 236 includes a rotator pin 237 and is mounted in a second actuator housing 234. The second actuator housing 234 is mounted to the mounting plate 201 using suitable fasteners. The second actuator 236 may be any suitable actuator such as a suitable actuator such as an electric stepper motor, which causes the rotator pin 237 to rotate. The second actuator 236 fits within the second actuator housing 234 so that the rotator pin 237 extends down through the second actuator housing 234 and extends from the bottom of the housing. A first pulley support 238 is secured to the rotator pin 237. Similarly, a second pulley support 242 is secured to the shaft 215. A pulley belt or belt 240 fits within a channel or groove integrally formed on each of the pulley supports 238 and 242. The belt 240 is manufactured of a suitable durable material such as rubber, which will extend between the pulley supports.

In operation, the disk transport plate 228 engages one of the disk arms 225. The processor 38 communicates with the second actuator 236 to activate the second actuator and cause the actuator to rotate the rotator pin 237. As the rotator pin 237 rotates, the first pulley support 238 rotates, which in turn rotates the belt 240. The belt 240 thereby rotates the second pulley support 242, which is secured to the shaft 215. The rotation of the second pulley support 242 causes the shaft 215 to rotate. As the shaft 215 rotates, the support transport member 224 moves the disk transport housing, which includes the disk transport plate 228, relative to the shaft 215. The rotation of the shaft 215 causes the threads of the shaft 215 to engage the corresponding threads of the support transport member 224. This causes a corkscrew effect which causes the support transport member 224 to move along the threads relative to the shaft 215. As the disk transport housing 226 moves relative to the shaft 215, the disk transport plate 228 also moves. This causes the disk transport plate 228 to push up against the disk arm 225 which is engaged with or rests on top of the disk transport plate 228. Accordingly, the disk or disks 210 which are adjacent or positioned on top of the disk including the disk arm 225 which is engaged with the disk transport plate 228, move in accordance with that disk transport plate 228. In a game, the above components move the disks up or down the shaft 215 within the second housing 212 to indicate an award symbol 214 on one of the disks 210 on or relative to the payline 207 shown in FIG. 6A.

A first actuator 230 is secured to the bottom of the disk transport housing 226 and is activated by the processor 38 to rotate the disk transport plate 228. The disk transport plate 228 is configured so that when the disk transport plate 228 rotates it may engage and disengage from one or more of the disk arms 225. The disk transport housing 226 and the disk transport plate 228 then may move along the shaft 215 to engage a different disk arm 225. Once the disk transport plate 228 is positioned adjacent to a desired disk arm 225, the first actuator 230 is activated or energized and rotates the disk transport plate 228 so that the disk transport plate 228 engages the desired disk arm 225. In this manner, the disk transport plate 228 may move along the shaft 215 to engage one or more of the disk arms 225. Thus, any one of the disks, several of the disks or all of the disks 210 can be moved in a game.

It should also be appreciated that the embodiments disk displays illustrated in FIGS. 1A, 1B and 1C may be incorporated in a primary game, secondary game, a sub-game or any other type of game affiliated with a gaming device.

While the present invention is described in connection with what is presently considered to be the preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a cabinet;

a game;

a triggering event in the game;

a housing secured to the cabinet;

a plurality of slidable disks mounted in the housing and operable to slide relative to the housing and along a common axis, each disk including at least one award symbol; and a processor which controls the game and causes at least one of the disks to slide relative to the housing to display the award symbol on the disk to a player if the triggering event occurs in the game.

2. The gaming device of claim 1, wherein at least a portion of the housing includes a transparent material.

3. The gaming device of claim 1, wherein the housing defines at least one opening.

4. The gaming device of claim 1, wherein the housing is cylindrical.

5. The gaming device of claim 1, wherein the disks are cylindrical.

6. The gaming device of claim 1, which includes a storage receptacle mounted on the housing.

7. The gaming device of claim 1, wherein the disks each include a plurality of award symbols.

8. The gaming device of claim 7, wherein the award symbols are different.

9. The gaming device of claim 1, which includes an actuator connected to the housing, which slides at least one of the disks relative to the housing.

10. A gaming device comprising:

a cabinet;

a game;

a triggering event in the game;

a support connected to the cabinet;

a plurality of disks slideably connected to the support and operable to slide relative to the support and along a common axis, each disk including at least one award symbol; and a processor which controls the game and causes at least one of the disks to slide relative to the support to display the award symbol on the disk to a player if the triggering event occurs in the game.

11. The gaming device of claim 10, wherein the support is cylindrical.

12. The gaming device of claim 10, wherein the disks are cylindrical.

13. The gaming device of claim 10, wherein the support is rotatably connected to the cabinet.

14. The gaming device of claim 10, wherein each disk includes a plurality of award symbols.

15. The gaming device of claim 14, wherein the award symbols are different.

16. The gaming device of claim 10, which includes an actuator which slides the disks relative to the support.

17. A gaming device comprising a cabinet;

a game;

a triggering event in the game;

a housing connected to the cabinet;

a support mounted in the housing;

a plurality of slidable disks positioned in the housing and operable to slide relative to the support and along a common axis, each disk including at least one award symbol; and a processor which controls the game and causes at least one of the disks to slide relative to the support to display the award symbol on the disk to a player if the triggering event occurs in the game.

18. The gaming device of claim 17, wherein at least a portion of the housing includes a transparent material.

19. The gaming device of claim 17, wherein the housing defines at least one opening.

20. The gaming device of claim 17, wherein the housing is cylindrical.

21. The gaming device of claim 17, wherein the disks are cylindrical.

22. The gaming device of claim 17, which includes a storage receptacle mounted on the housing.

23. The gaming device of claim 17, wherein the support is rotatably mounted inside the housing.

24. The gaming device of claim 17, wherein each disk includes a plurality of award symbols.

25. The gaming device of claim 24, wherein the award symbols are different.

26. The gaming device of claim 17, which includes an actuator which slides the disks relative to the support.

27. A gaming device comprising:

a cabinet;

a game;

a triggering event in the game;

a housing connected to the cabinet;

a support mounted in the housing;

a plurality of slidable disks positioned in the housing in slidable engagement with the support and slidable along a common axis, said plurality of slidable disks including at least a first disk slidable relative to the support and a second disk slidable relative to the support;

at least one award symbol on each of a plurality of the disks; and a processor which controls the game and causes the first disk to slide relative to the support and to the second disk, and to display the award symbol on one of the disk to a player if the triggering event occurs in the game.

28. The gaming device of claim 27, wherein the disks include different award symbols.

29. The gaming device of claim 27, wherein the diameters of the disks are different.

30. The gaming device of claim 27, wherein each of the disks includes a plurality of award symbols.

31. The gaming device of claim 30, wherein the award symbols are different.

32. The gaming device of claim 27, wherein each of the disks includes a different color.

33. A gaming device comprising:

a cabinet;

a game;

a triggering event in the game;

a plurality of housings connected to the cabinet;

a plurality of slidable disks positioned in the housings and operable to slide relative to the housings and along a common axis, the plurality of slidable disks including at least a first disk and a second disk;

at least one symbol on each of a plurality of the disks; and a processor which controls the game and causes the first disk to slide relative to one of the housings and to the second disk to display the symbol on one of the disks to a player if the triggering event occurs in the game.

34. The gaming device of claim 33, wherein at least one disk is positioned in and slides relative to each of the housings.

35. The gaming device of claim 33, which includes a plurality of award symbols included on each of the disks.

36. The gaming device of claim 33, wherein the processor causes the second disk to slide relative to one or more of the housings.

37. The gaming device of claim 33, wherein the processor causes at least an additional disk to slide relative to at least one of the housings.

38. The gaming device of claim 33, which includes at least one selector in communication with the processor.

39. The gaming device of claim 33, wherein each of the housings is substantially transparent.

40. A gaming device comprising:

a cabinet;

a game;

a triggering event in the game;

a plurality of supports connected to the a cabinet;

a plurality of disks in slidable engagement with the supports and slidable along a common axis, the plurality of disks including at least a first disk slidable relative to the supports and a second disk slidable relative to the supports;

at least one symbol on each of a plurality of the disks; and a processor which controls the game and causes the first disk to slide relative to the supports and to the second disk to display the symbols on the disks to a player if the triggering event occurs in the game.

41. The gaming device of claim 40, wherein the supports are rotatably connected to the gaming device.

42. A gaming device comprising:

a housing;

a plurality of sliding members positioned in the housing and adapted to move relative to the housing and movable along a common axis, each sliding member including at least one award symbol; and a processor which causes at least one of the sliding members to move in the housing to reveal the award symbol to a player if a triggering event occurs in a game.

43. The gaming device of claim 42, wherein the housing is cylindrical.

44. The gaming device of claim 42, wherein the sliding members each include a cylindrical disk.

45. The gaming device of claim 42, which includes a support mounted in the housing and operable to receive the sliding members.

46. The gaming device of claim 45, wherein the support is rotatably mounted in the housing.

47. A gaming device comprising:

a cabinet;

a game;

a triggering event in the game;

a housing secured to the cabinet, wherein the housing includes a payline;

a plurality of slidable disks mounted in the housing and operable to slide relative to the housing and along a common axis, each disk including at least one award symbol and an arm transversely extending from the disk;

a disk mover attached to the cabinet and in engagement with the disk arm; and a rotation generator coupled to the disk mover, wherein the rotation generator is operable to rotate the disk mover, cause the disk mover to move the arm and slide at least one of the disks within the housing until the award symbol on the disk is indicated on the payline associated with the housing.

48. The gaming device of claim 47, wherein the disk mover includes a transport shaft and a disk transport housing coupled with the transport shaft, wherein the disk transport housing includes a disk transport plate which engages the disk arm.

49. The gaming device of claim 48, which includes an actuator coupled to the disk transport plate to rotate the disk transport plate and enable the disk transport plate to engage and disengage from the disk arm.

50. The gaming device of claim 48, wherein the disk transport housing and the transport shaft are in threaded engagement.

51. The gaming device of claim 48, which includes an intermediate plate coupled with the disk transport housing, wherein the intermediate plate is adapted to accept at least one electrical connection.

52. The gaming device of claim 47, wherein the rotation generator includes a housing and an actuator mounted in said housing.

53. The gaming device of claim 52, wherein the actuator includes a rotator pin.

54. The gaming device of claim 53, which includes a belt extending between the disk mover and the rotator pin, wherein the belt is in rotational engagement with the disk mover and the rotator pin.

55. The gaming device of claim 47, wherein at least a portion of the housing includes a transparent material.

56. The gaming device of claim 47, wherein the housing defines at least one opening.

57. The gaming device of claim 47, wherein the housing is cylindrical.

58. The gaming device of claim 47, wherein the housing includes a first housing and a second housing.

59. The gaming device of claim 47, wherein the disks are cylindrical.

60. The gaming device of claim 47, which includes a storage receptacle positioned on and secured to a top of the housing.

61. The gaming device of claim 47, wherein each of the disks includes a plurality of award symbols.

62. The gaming device of claim 61, wherein the award symbols are different.

63. The gaming device of claim 47, which includes an actuator connected to the housing, which slides the disks relative to the housing.

64. A method of operating a wagering gaming device including a plurality of disks which slide relative to a support mounted in a housing and which slide along a common axis, said method comprising the steps of:

(a) initiating a game; and (b) sliding one of the disks relative to the support to reveal an award symbol included on the disk when a triggering event occurs in the game.

65. The method of claim 64, which includes the step of moving the plurality of disks relative to the support to reveal the award symbols included on each of the disks.

66. The method of claim 64, which includes the step of rotating the support to reveal different award symbols included on at least one of the disks.

67. The method of claim 64, which includes the step of incrementally rotating the support to reveal different award symbols included on at least one of the disks.

68. The method of claim 64, wherein the steps (a) to (b) are controlled through a data network.

69. A method of operating a wagering gaming device including a plurality of disks which slide relative to a support mounted in a housing and which slide along a common axis, wherein the plurality of disks include at least a first disk and a second disk, said method comprising the steps of:

(a) initiating a game; and (b) sliding the first disk relative to the support and the second disk to reveal an award symbol on the disks if an award triggering event occurs in the game.

70. The method of claim 69, which includes the step of rotating the support to reveal one of several award symbols included on the disks.

71. The method of claim 69, wherein the steps (a) to (b) are controlled through a data network.

72. A method of operating a wagering gaming device including a plurality of disks connected to supports mounted in a plurality of housings and arranged along a common axis, said method comprising the steps of:

(a) initiating a game; and (b) sliding at least one of the disks along the common axis and relative to the support in one of the housings to reveal one of a plurality of award symbols on the disks if a triggering event occurs in the game.

73. The method of claim 72, which includes the step of sliding a plurality of disks on one of the supports in the housings.

74. The method of claim 72, which includes the step of sliding a plurality of disks relative to the supports in the plurality of housings.

75. The method of claim 74, wherein all of the disks slide on the supports at approximately the same time.

76. The method of claim 74, wherein all of the disks slide on the supports sequentially.

77. The method of claim 72, wherein the steps (a) to (b) are controlled through a data network.

78. A gaming device comprising:

a cabinet;

a game;

a triggering event in the game;

a housing secured to the cabinet;

a plurality of slidable disks mounted in the housing and operable to slide relative to the housing and slidable along a common axis, each disk including at least one symbol;

a disk transport plate movably connected to the cabinet and operable to engage and disengage the disks; and a processor which controls the game and causes the disk transport plate to engage and slide the disks relative to the housing to display the symbol on the disks to a player when the triggering event occurs in the game.

79. The gaming device of claim 27, wherein at least one additional disk is slidable relative to the support.

80. The method of claim 69, wherein at least one additional disk is slidable relative to the support.

81. A gaming system having a game operable upon a wager, said gaming system comprising:

a cabinet;

at least one support connected to the cabinet;

a plurality of disks in slidable engagement with the at least one support, the plurality of disks slidable relative to one another and slidable along a common axis such that in a first position at least a first one of the disks is spaced apart a distance from at least a second one of the disks, and in a second position the at least first one of the disks is spaced apart a greater distance from the at least second one of the disks;

at least one symbol on each of a plurality of the disks; and at least one processor configured to cause at least one of the disks to slide a distance toward or away from at least another one of the disks if a triggering event occurs.

82. The gaming system of claim 81, wherein the at least one processor is configured to cause a plurality of the disks to slide toward or away from at least another one of the disks if a triggering event occurs.

83. The gaming system of claim 82, wherein the at least one processor is configured to cause a plurality of the disks to slide toward or away from a plurality of other disks if a triggering event occurs.

* * * * *